US009933143B2

(12) United States Patent
Chancey

(10) Patent No.: US 9,933,143 B2
(45) Date of Patent: Apr. 3, 2018

(54) ENGAGEMENT SYSTEM AND METHOD FOR MOUNTING LIGHTING FIXTURE

(71) Applicant: GE Lighting Solutions, LLC, East Cleveland, OH (US)

(72) Inventor: John Edward Chancey, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 162 days.

(21) Appl. No.: 14/882,664

(22) Filed: Oct. 14, 2015

(65) Prior Publication Data

US 2017/0009964 A1 Jan. 12, 2017

Related U.S. Application Data

(60) Provisional application No. 62/189,438, filed on Jul. 7, 2015.

(51) Int. Cl.
*F21V 21/04* (2006.01)

(52) U.S. Cl.
CPC ..... *F21V 21/04* (2013.01); *F21V 21/042* (2013.01); *F21V 21/044* (2013.01)

(58) Field of Classification Search
CPC ..... F21V 21/04; F21V 21/042; F21V 21/044; F21V 21/046
See application file for complete search history.

(56) References Cited

U.S. PATENT DOCUMENTS 3,620,401 A * 11/1971 Lund ..... H02G 3/123 220/3.6
4,039,822 A 8/1977 Chan et al.
4,088,293 A 5/1978 Delmore
4,238,815 A * 12/1980 Price ..... F21S 8/02 362/218
4,685,037 A 8/1987 Akiyama et al.
(Continued)

FOREIGN PATENT DOCUMENTS

AU 411004 B2 3/1971
DE 10 2007 036 979 A1 11/2008
(Continued)

OTHER PUBLICATIONS

WO 1996-018068 , Jun. 1996, Kempter et al, English Translation.*
(Continued)

*Primary Examiner* — Peggy Neils
(74) *Attorney, Agent, or Firm* — Peter T. DiMauro; GE Global Patent Operation

(57) ABSTRACT

Provided is a system for attachment to a lighting fixture including lens components within a recess of a substantially flat surface. The system includes a tension mechanism configured for rotatable movement in response to an applied force. The system also includes a tether configured to provide the applied force and facilitate movement of the tension mechanism from a minimum tension position to a maximum tension position. The tether attaches to the tension mechanism and is assessable at a position approximate to the lens components of the lighting fixture. Also provided is a method for mounting the lighting fixture using the tension mechanism engaged by the tether.

22 Claims, 6 Drawing Sheets

(56) References Cited

U.S. PATENT DOCUMENTS

| | | | | |
|---|---|---|---|---|
| 4,956,758 | A * | 9/1990 | Aubrey | F21V 21/04 362/285 |
| 5,068,772 | A | 11/1991 | Shapiro et al. | |
| 5,122,944 | A | 6/1992 | Webb | |
| 5,299,952 | A * | 4/1994 | Hinds, Jr. | F21V 21/03 362/403 |
| 5,377,088 | A | 12/1994 | Lecluze | |
| 5,567,041 | A | 10/1996 | Slocum | |
| 5,964,523 | A | 10/1999 | Eversberg | |
| 6,000,818 | A | 12/1999 | Caluori | |
| 7,494,254 | B2 * | 2/2009 | Rogers | F21S 8/06 362/404 |
| 9,052,101 | B1 | 6/2015 | Kathawate et al. | |
| 2005/0207146 | A1 | 9/2005 | Reggiani | |
| 2010/0039829 | A1 | 2/2010 | Tsai | |
| 2011/0180678 | A1 * | 7/2011 | Liu | F21V 21/046 248/343 |
| 2011/0235342 | A1 | 9/2011 | Liang | |
| 2017/0009963 | A1 | 1/2017 | Germain et al. | |

FOREIGN PATENT DOCUMENTS

| | | | |
|---|---|---|---|
| DE | 20 2013 008 171 | U1 | 9/2013 |
| EP | 2 140 197 | A1 | 1/2010 |
| EP | 2 314 914 | A1 | 4/2011 |
| JP | S57-45712 | U | 3/1982 |
| JP | 2870636 | B1 | 3/1999 |
| WO | 96/18068 | A1 | 6/1996 |
| WO | 2008/135126 | A1 | 11/2008 |
| WO | 2012/088721 | A1 | 7/2012 |

OTHER PUBLICATIONS http://www.youtube.com/watch?v=Tob89ByGhL4.

Extended European Search Report and Opinion issued in connection with related EP Application No. 15167640.0 dated Jul. 20, 2015.

Non-Final Rejection towards U.S. Appl. No. 14/278,897 dated Aug. 5, 2016.

Extended European Search Report and Opinion issued in connection with corresponding EP Application No. 16177855.0 dated Nov. 3, 2016.

Notice of Allowance towards U.S. Appl. No. 14/278,897 dated Jan. 31, 2017.

* cited by examiner

ENGAGEMENT SYSTEM AND METHOD FOR MOUNTING LIGHTING FIXTURE

FIELD OF THE INVENTION

The present invention is related to installation of lighting fixtures. More specifically, the present invention relates to systems for mounting lighting fixtures in locations, such as a ceiling.

BACKGROUND OF THE INVENTION

Luminaires are increasingly relied upon for white light production in downlight high-ceiling applications. These applications provide lighting for offices, retail space settings, and other commercial applications. Additionally, more recently developed downlight luminaires also include advanced lighting technology that is inherently more sustainable, while providing significant energy savings than predecessor, or legacy systems.

High-ceiling luminaire applications, however, are generally associated with inherent maintenance inefficiencies. For example, in addition to costs associated with lamp replacement, lifts and scaffolding are usually required to safely perform installation and maintenance for high-ceiling luminaires. These installation and maintenance challenges are further complicated because many of these luminaires are recessed and simply difficult to install or remove.

To assist the installation process, many conventional downlight luminaires include sheet-metal fixing springs on opposing sides of the luminaire for recessed installations through recesses/carveouts in the ceiling. These conventional downlights provide two springs and expect installers to use their hands to position them appropriately for installation. However, installation of downlights using springs can pose a risk of injury to the installers' fingers, hand, or other body parts. Additionally, it is difficult for installers to position, hold, and release more than two springs at the same time during installation in an upward vertical position. Furthermore, the use of only two tension mechanisms may not support the weight of heavier downlight fixtures, causing these fixtures to sag or tilt after installation.

SUMMARY OF THE EMBODIMENTS

Given the aforementioned deficiencies, a need exists for mounting systems and methods to facilitate improve the ease of installation of luminaires, and other recessed fixtures, into a ceiling, wall, or other substantially flat surface.

Embodiments of the present invention include a system for mounting a lighting fixture including lens components within a recess of a substantially flat surface. The system includes a tension mechanism configured for rotatable movement in response to an applied force. In the embodiments, the tension mechanism can include a spring clamp. The system also includes a tether configured to provide the applied force and facilitate movement of the tension mechanism from a minimum tension position to a maximum tension position. The tether attaches to the tension mechanism and is assessable at a position approximate to the lens components.

In some embodiments, the substantially flat surface includes a ceiling or a wall. In particular embodiments, the recess is a carveout area in the ceiling.

In some embodiments, the tether attaches to the tension mechanism and travels through an opening on the exterior of the housing. In some embodiments, the tether attaches to a loop feature affixed to the tension mechanism.

In some embodiments, the tether is accessible to the user within the lens component at a location approximate to a diffuser. In some embodiments, the tether is accessible to the user within the lens component at a location approximate to a reflector. In some embodiments, the tether is accessible to the user within the lens component at a location approximate to a lens trim.

In some embodiments, the lighting fixture also includes a recoil mechanism configured to store the tether when the tether is not in use. In some embodiments, the recoil mechanism comprises a torsion spring.

In some embodiments, the tether further comprising a stop configured to attach to a tool for applying approximately uniform and synchronized tension on the tether to move the tension mechanism to the maximum tension position.

An advantage of the embodiments is allowing for simple installation and uninstallation of downlight fixtures. In conventional techniques, to install or uninstall the downlight fixture uninstallers typically have to squeeze their fingers in between the ceiling and reflector in order to insert the fixture into the ceiling or pull the fixture out of the ceiling. With these systems and methods, installers and uninstallers position the tension mechanisms in a maximum tension position to allow the fixture to be inserted into and released from the ceiling without pinch risk—e.g., to the hands of the installer/uninstaller.

Another advantage is providing multiple torsion mechanisms (e.g., spring coils) to provide sufficient strength and ensure a balanced fixture. Multiple tension mechanisms allow use of one or more tethers on larger and heavier downlight fixtures. In conventional systems, with hands alone, it would be difficult for installers to engage three or more tension mechanisms at one time to install or uninstall the downlight fixture. However, with these systems and methods, installers/uninstaller will be able to activate all torsion mechanism at one time.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

To provide a thorough understanding of the present disclosure, embodiments of the present invention are described below with reference to the accompanying drawings, wherein.

DETAILED DESCRIPTION

While illustrative embodiments are described herein with illustrative embodiments for particular implementations, it should be understood that the invention is not limited thereto. Those skilled in the art with access to the teachings provided herein will recognize additional modifications, applications, and embodiments within the scope thereof, and additional fields in which the lighting systems described herein would be of significant utility.

The following detailed description is merely exemplary in nature and is not intended to limit the applications and uses disclosed herein. Further, there is no intention to be bound by any theory presented in the preceding background or summary or the following detailed description.

The embodiments address concerns associated with mounting a downlight lighting fixture into a recess in a ceiling or other substantially flat surface or sub-surface. The ceiling may be associated with an office, a retail location, or similar environment.

Figure 1:
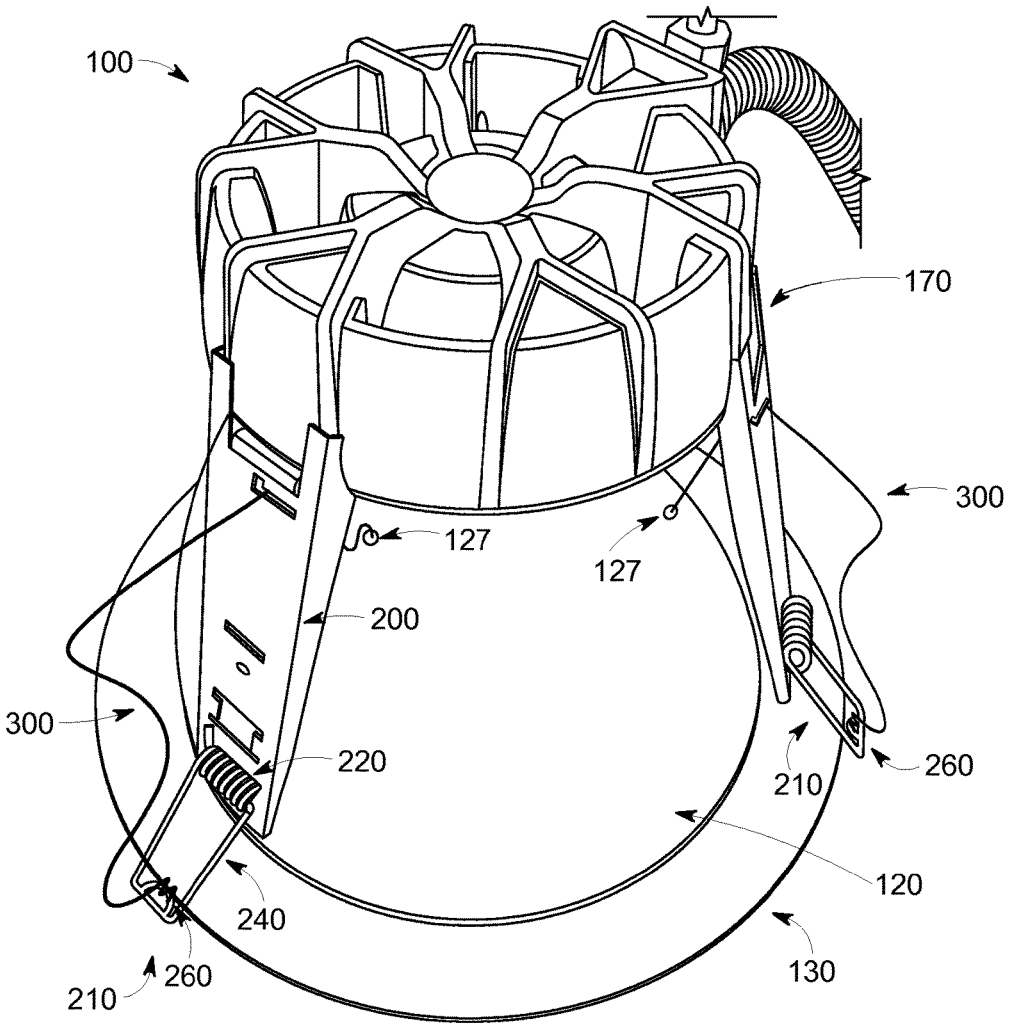
FIG. 1 depicts a perspective side view of a lighting fixture using a bracket assembly in accordance with an exemplary embodiment of the present invention.

FIG. 1 depicts a perspective side view of a lighting fixture using a bracket assembly in accordance with an exemplary embodiment of the present invention. The lighting fixture 100 includes (i) a housing 120 enclosing electronics, such as an infusion module, (ii) lens components 130, configured for emitting, diffusing, or otherwise passing light emitted by lights (e.g., LEDs), and (iii) a heat sink 170 to provide cooling for optics and other embedded electronics within the housing 120. The lighting fixture 100 further includes a bracket assembly 200 attached or otherwise affixed to a portion of the lighting fixture 100, such as the heat sink 170.

The bracket assembly 200 includes a tension mechanism, such as a spring clamp 210 (illustrated in FIG. 1) having a spring coil 220 and a spring arm 240. In a minimal tension position, the spring coil 220 has a preset amount of tension within its coil windings. During installation of the lighting fixture 100, the spring arm 240 is moved from the minimal tension position to a maximum tension position that produces additional tension greater than the preset tension in the spring coil 220. Specifically, the spring arm 240 is raised from the minimal position to the maximum tension position, which creates additional tension in the spring coil 220.

In some embodiments, a plurality of spring clamps 210 are positioned around the circumference of the housing 120. Multiple spring clamps 210 allow installation of larger and heavier downlight fixtures within ceiling recesses for example. With hands alone, it would be difficult for installers to engage three or spring clamps 210 at one time to install or uninstall the lighting fixture 100. Other suitable configurations are spring available, such as but not limited to machined springs and flat springs, as understood by those of skill in the art, and would be within the spirit and scope of the present invention.

The housing 120 includes one or more openings 127 (illustrated in FIG. 1) to allow passage of a tether 300 described in detail below, from the exterior of the housing 120, through one or more openings 125 (illustrated in FIG. 2) in the interior of the housing 120. The openings 125, 127 allow the tether 300 to pass from location not easily accessed by an installer/uninstaller when the lighting fixture 100 is mounted to a location easily accessed after mounting. For example, the opening 125 allows the tether to attach to the spring clamp 210 that is positioned within a ceiling 102 after installation of the lighting fixture 100.

The tether 300 simplifies installation of the lighting fixture 100 by eliminating the need for a user to holding springs, or mounting clamps, under tension while inserting the lighting fixture 100 through a recess 110. Specifically, the tether 300 is configured to temporarily position and secure the spring clamp 210 in the maximum tension position prior to installation of the lighting fixture 100. In this manner, the risk of injury to an installer is substantially reduced. Additionally, risk of injury to the installer is reduced due to the deployment of the tether 300 by the installer/uninstaller at a location outside of the ceiling 102.

The tether 300 is configured to rotate the spring clamp 210 about an axis of the spring coil 220. The spring clamp 210 is rotated from a minimal tension position prior to installation to a maximum tension position for installation and finally back to the minimum tension position after installation. When the spring clamp 210 is in the minimal tension position, tether 300 is in a position where the material of the tether 300 is not tightened. To position each of the spring clamp 210 in the maximum tension position, the tether 300 is tightened using a tool 500 (illustrated in FIG. 4B) or other item used to pull any slack from within the material of the tether 300. Once the spring clamps 210 are released after installation, the tether 300 returns to the loosened or non-tightened position. One or more tethers 300 can be used at the same time or approximately simultaneously by the installers/uninstaller to place one or more spring clamps 210 in the maximum tension position.

The tether 300 may be composed of one or more materials configured to support the spring arm 240 when the spring coil 220 is placed under additional tension, causing the spring clamp 210 to be placed in the maximum tension position. Specifically, the tether 300 is composed of materials that allows movement for at least some flexibility and tension. The tether 300 may be composed of one or more cords or string composed of plastic (e.g., nylon), metal (e.g., steel), or a combination thereof. The tether 300 may be subsequently added to the lighting fixture 100 in a post manufacturing operation.

In some embodiments, the tether 300 is attached to a loop 260 or other securing feature on the spring clamp 210, as illustrated in FIG. 1. The loop 260 may be attached or otherwise affixed to a position on the spring clamp 210 such as the spring arm 240 using conventional techniques, such as but not limited to welding.

Figure 2:
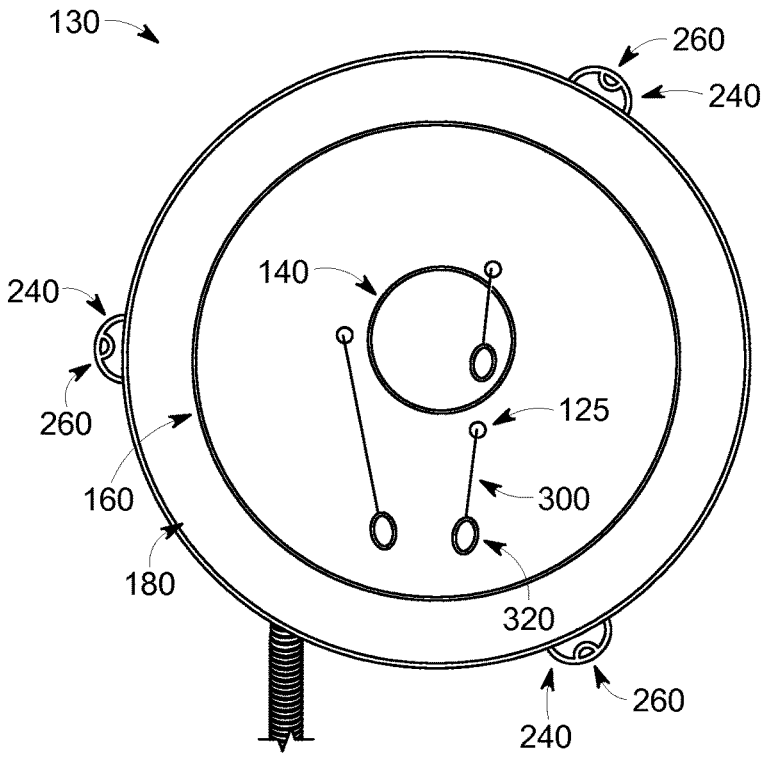
FIG. 2 depicts a front view of the lighting fixture of FIG. 1.

FIG. 2 illustrates exemplary lens components 130, including a diffuser 140, a reflector 160, and trim 180. In some embodiments, the tether 300 passes from the exterior of the housing 120 through the interior of the housing 120 and exit at or within the area occupied by the lens components 130. For example the tether 300 exits at an area near the diffuser 140 or the reflector 160 through pre-drilled holes. Each tether 300 is fed into the inside of the reflector 160 where the installer/uninstaller will be able to access all tethers 300 at same time. In some embodiments, the tether 300 remains on the exterior of the housing 120 (e.g., away from the electronic components), and exit at a location approximate to the trim 180.

In some embodiments, the tether 300 includes a hook or stopper 320, as illustrated in FIG. 2. The stopper 320 may be affixed or subsequently to the tether 300. The stopper 320 serves to prevent the tether 300 from being pushed too far into the interior of the housing 120, which may be out of reach of the installer/uninstaller. The stopper 320 also serves to temporarily attach or secure each tether 300 to the tool 500 or other object to promote generally simultaneously positioning of the spring clamps 210 in the maximum tension position and releasing the spring clamps 210 to the minimum tension position.

Figure 3A:
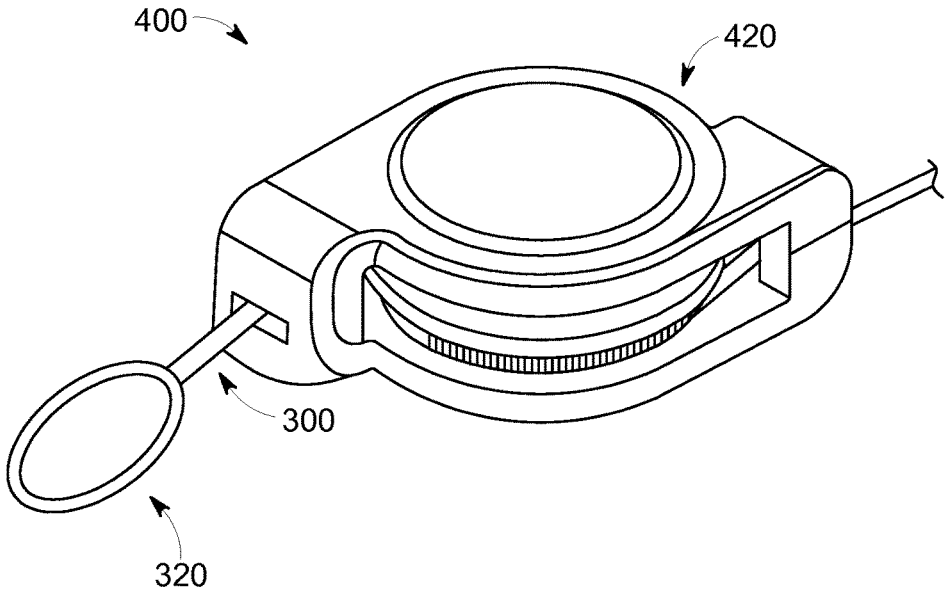
FIG. 3A depicts an exemplary recoil mechanism for recoiling tethers of the lighting fixture.

FIG. 3A depicts a recoil mechanism 400 for retracting the tethers 300. For example, the tethers 300 are retracted or otherwise stored to prevent the tethers 300 from obstructing the lens components 130. The recoil mechanism 400 may be configured such that both ends of the tether 300 can be pulled out of the recoil mechanism 400 for use and stored within the recoil mechanism 400 for when not in use.

In some embodiments, the recoil mechanism 400 may be positioned on the exterior of the housing 120 (e.g., near the opening 127). In other embodiments, the recoil mechanism 400 is positioned on the interior of the housing 120, not visible to the installer/uninstaller. In yet other embodiments, the recoil mechanism 400 may be positioned visible to the installer/uninstaller near the lens components 130 of the lighting fixture 100 (e.g., near the opening 125).

Figure 3B:
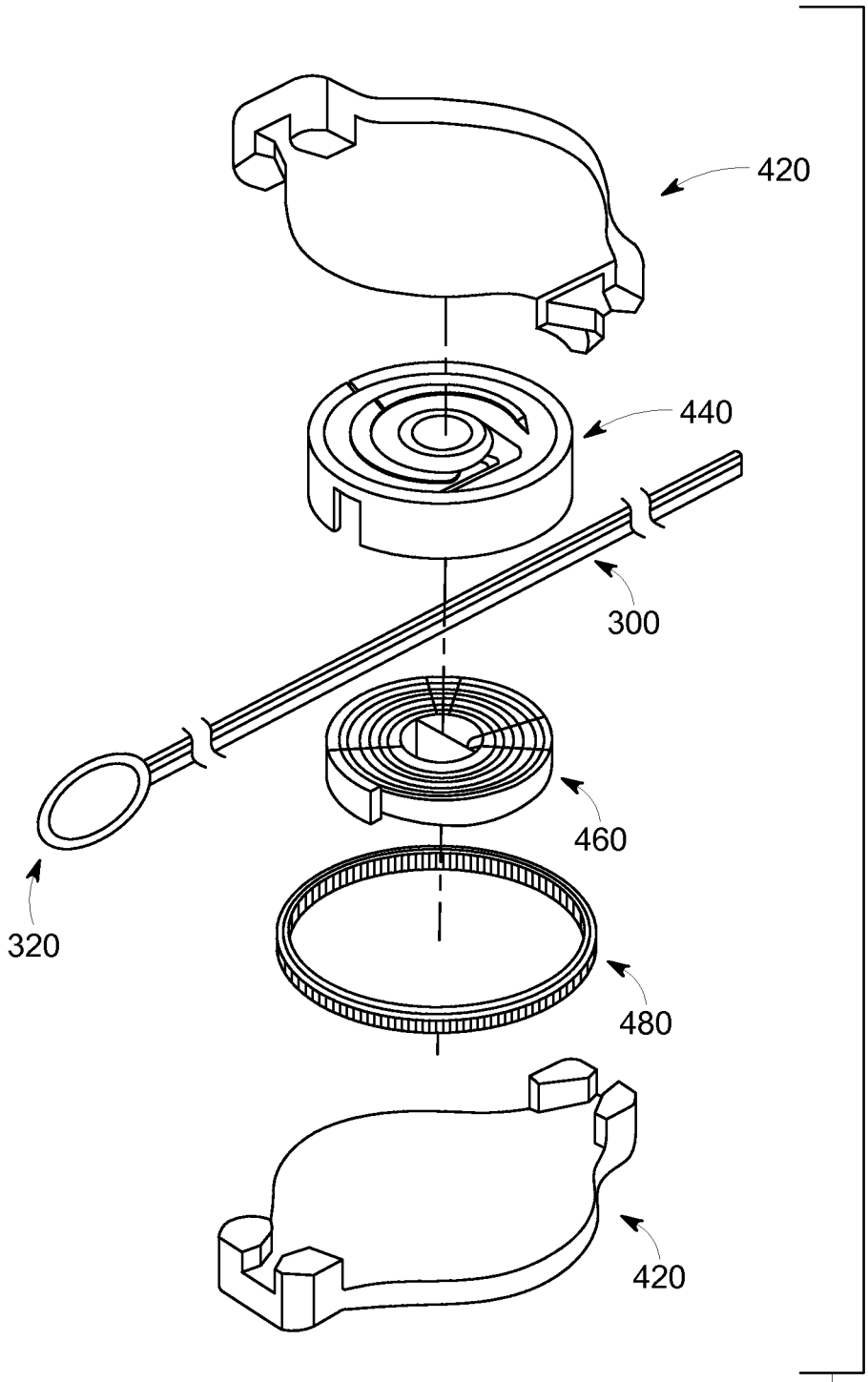
FIG. 3B depicts an exploded view of the recoil mechanism of FIG. 3A.

FIG. 3B depicts and exploded view the recoil mechanism 400 including a casing 420 that houses internal components such as, a turntable 440, a torsion spring 460, and a retaining base 480. The recoil mechanism 400 may contain additional components such as screws, pins or other devices which are used to secure the casing 420 around the internal components.

The retaining base 480 includes the turntable 440 which are both coupled to the casing 420, for example using an axle pole positioned on the casing 420. The turntable 440 may include a positioning hole pivotally configured to couple to the casing 420, using the axle pole. The turntable 440 may include at least one groove on the periphery of the turntable 440 configured to position the tether 300 within the turntable 440.

The turntable 440 also includes the torsion spring 460 having a latch end located at an inner side of the torsion spring 460. The torsion spring 460 allows the tether 300 to be passed into the groove(s) of the turntable 440, such that both ends of the tether 300 can be pulled out. The latch end is configured to couple to the casing 420, for example using the axle pole.

Figure 4A:
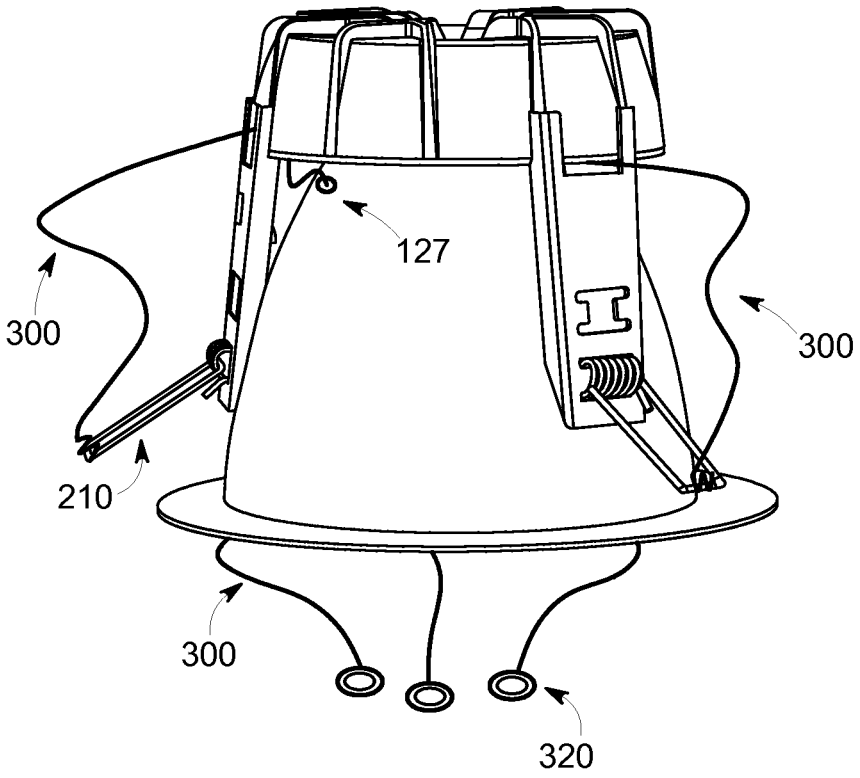
FIG. 4A-4C depicts a method of installing the lighting fixture of FIG. 1 into a ceiling.
Figure 4B:
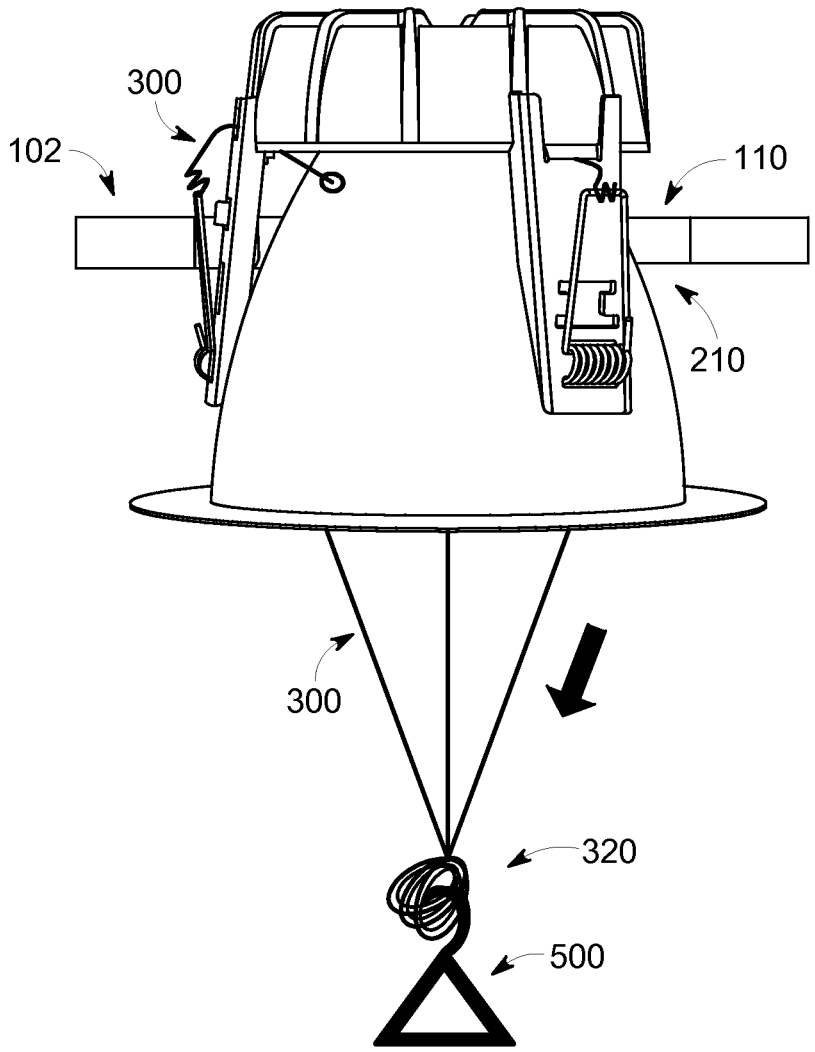
Figure 4C:
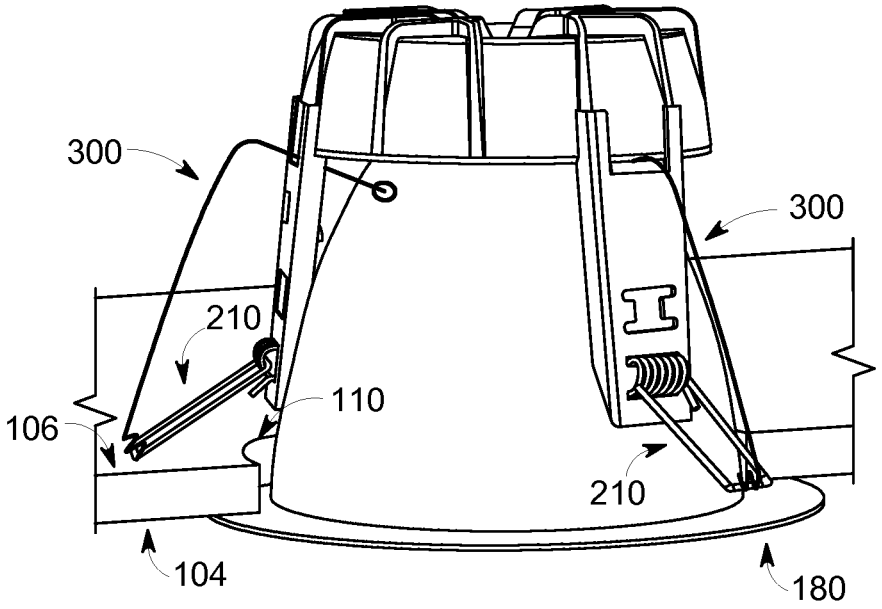

FIGS. 4A-4C illustrate exemplary stages occurring during installation of the lighting fixture 100 through the recess 110 using the tethers 300. In FIG. 4A, the spring clamps 210 begin in the minimum tension position and the tethers 300 are in the non-tightened (loosened) position. The lighting fixture 100 is ready for installation when the spring clamps 210 are in the maximum tension position.

The spring clamps 210 are placed in the maximum tension positions by tightening the tethers 300 in a direction as illustrated by the arrow as illustrated in FIG. 4B. As stated above, the tethers 300 may be tightened using the tool 500 or other item used to pull any slack from within the material of tether 300. As illustrated, the lighting fixture 100 is positioned to be received by the recess 110 of the ceiling 102. Specifically, the heat sink 170 and the housing 120 are positioned to pass through the recess 110.

In FIG. 4C, once the housing 120 has passed through the recess 110, the tethers 300 are loosened and the spring clamps 210 are released from the maximum tension position and allowed to return to the minimum tension position. After the spring clamps 210 are released, the spring arms 240 of each spring clamp 210 is positioned in contact with a second surface 106 of the ceiling 102. In the installed position, the housing 120 has passed through the recess 110 and the trim 180 is positioned in contact or nearly in contact with the first surface 104 of the ceiling 102.

To uninstall the lighting fixture 100, the tethers 300 are tightened, using the tool 500 or otherwise, to position the spring clamps 210 in the maximum tension position. Once the spring clamps 210 are in the maximum tension position, the lighting fixture 100 can be moved out of the recess 110. Once removed, the tethers 300 are be loosed, allowing the spring clamps 210 to return to the minimum tension position. The tethers 300 can subsequently be stored (e.g., using the recoil mechanism 400) for future use.

CONCLUSION

Those skilled in the art, particularly in light of the foregoing teachings, may make alternative embodiments, examples, and modifications that would still be encompassed by the technology. Further, it should be understood that the terminology used to describe the technology is intended to be in the nature of words of description rather than of limitation.

Those skilled in the art will also appreciate that various adaptations and modifications of the preferred and alternative embodiments described above can be configured without departing from the scope and spirit of the technology. Therefore, it is to be understood that, within the scope of the appended claims, the invention may be practiced other than as specifically described herein.

What I claim is:

1. A system for mounting a lighting fixture including lens components within a recess of a substantially flat surface, the system comprising:

a tension mechanism configured for rotatable movement in response to an applied force;

a tether configured to provide the applied force and facilitate movement of the tension mechanism from a minimum tension position to a maximum tension position, wherein the tether attaches to the tension mechanism and is accessible at a position approximate to the lens components; and a recoil mechanism comprising a casing storing a portion between ends of the tether, wherein the ends of the tether extend outwards from the casing.

2. The system of claim 1, wherein the substantially flat surface includes at least one from a group including a ceiling and a wall.

3. The system of claim 2, wherein the recess is a carveout area in the ceiling.

4. The system of claim 1, wherein the tension mechanism includes at least one from a group including a spring clamp, a machined spring, and a flat spring.

5. The system of claim 1, wherein the tether attaches to a loop feature affixed to the tension mechanism.

6. The system of claim 1, wherein the tether is accessible within the lens components at a location approximate to a diffuser.

7. The system of claim 1, wherein the tether is accessible within the lens components at a location approximate to a reflector.

8. The system of claim 1, wherein the tether is accessible within the lens components at a location approximate to a lens trim.

9. The system of claim 1, wherein the recoil mechanism is configured to store the tether when not in use.

10. The system of claim 9, wherein the recoil mechanism comprises a torsion spring.

11. The system of claim 1, wherein the tether further comprises a stop configured to attach to a tool for applying approximately uniform and synchronized tension on the tether to move the tension mechanism to the maximum tension position.

12. A system for mounting a lighting fixture including lens components within a recess of a substantially flat surface, the system comprising:

a bracket assembly configured for attachment to the lighting fixture having a spring clamp configured for rotatable movement in response to an applied force; and a tether configured to provide the applied force and facilitate movement of the spring clamp from a minimum tension position to a maximum tension position, wherein the tether attaches to a tension mechanism and is assessable at a position approximate to the lens components; and a recoil mechanism comprising a casing storing a portion between ends of the tether, wherein the ends of the tether extend outwards from the casing.

13. The system of claim 12, wherein the tether attaches to a loop feature affixed to the spring clamp.

14. The system of claim 12, wherein the tether is accessible at a location proximate to one of a diffuser, a reflector, and a lens trim.

15. The system of claim 12, wherein the recoil mechanism is configured to store the tether when not in use.

16. The system of claim 15, wherein the recoil mechanism comprises a torsion spring.

17. The system of claim 12, wherein the tether further comprises a stop configured to attach to a tool for applying approximately uniform and synchronized tension on the tether to move the tension mechanism to the maximum tension position.

18. A method for mounting a lighting fixture including lens components the method comprising:

engaging a tension mechanism configured for rotatable movement in response to an applied force provided by tightening of a tether configured to facilitate movement of the tension mechanism from a minimum tension position to a maximum tension position, the tether attaching to the tension mechanism and being assessable at a position approximate to the lens components;

positioning the lighting fixture with the tension mechanism in the maximum tension position proximal to a recess of a substantially flat surface;

moving the lighting fixture through the recess;

releasing the tension mechanism by loosening the tether causing the tension mechanism to move from the maximum tension position back to approximately the minimum tension position; and storing, by a recoil mechanism, a portion between ends of the tether, wherein the ends of the tether extend outwards from a casing of the recoil mechanism.

19. A system of claim 1, further comprising a bracket assembly coupled to a heat sink of the lighting fixture and extended towards a housing of the lighting fixture, wherein the bracket assembly comprises the tension mechanism.

20. A system of claim 19, wherein one end of the tether is coupled to the tension mechanism and other end of the tether extends through a first opening of an exterior of the housing and through a second opening of an interior of the housing.

21. A system of claim 12, wherein the bracket assembly is coupled to a heat sink of the lighting fixture and extended towards a housing of the lighting fixture.

22. A system of claim 21, wherein one end of the tether is coupled to the spring clamp and other end of the tether extends through a first opening of an exterior of the housing and through a second opening of an interior of the housing.

* * * * *